US008258687B2

(12) United States Patent
Espiau et al.

(10) Patent No.: US 8,258,687 B2
(45) Date of Patent: Sep. 4, 2012

(54) COAXIAL WAVEGUIDE ELECTRODELESS LAMP

(75) Inventors: Frederick M. Espiau, Topanga, CA (US); Mehran Matloubian, Encino, CA (US); Alexandre Dupuy, San Diego, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 364 days.

(21) Appl. No.: 12/225,652

(22) PCT Filed: Mar. 28, 2007

(86) PCT No.: PCT/US2007/007696

§ 371 (c)(1),
(2), (4) Date: Jul. 6, 2010

(87) PCT Pub. No.: WO2007/126899

PCT Pub. Date: Nov. 8, 2007

(65) Prior Publication Data

US 2010/0283389 A1 Nov. 11, 2010

Related U.S. Application Data

(60) Provisional application No. 60/786,260, filed on Mar. 28, 2006, provisional application No. 60/786,995, filed on Mar. 30, 2006.

(51) Int. Cl.
*H01J 61/12* (2006.01)

(52) U.S. Cl. ..... 313/161; 313/634; 313/637; 313/641; 313/567

(58) Field of Classification Search ..... 313/231.61, 313/231.71, 231.31, 234, 317, 110, 621, 313/634, 635, 636, 637, 641, 252, 276, 607, 313/567, 238, 244, 256, 259; 315/39, 246, 315/111.41, 248, 112, 111.21
See application file for complete search history.

(56) References Cited

U.S. PATENT DOCUMENTS 5,013,959 A 5/1991 Kogelschatz (Continued)

FOREIGN PATENT DOCUMENTS

EP 1 601 003 A 11/2005

(Continued)

OTHER PUBLICATIONS

PCT International Search Report and the Written Opinion of the International Searching Authority for PCT/US2006/038787.

(Continued)

*Primary Examiner* — Joseph L Williams
*Assistant Examiner* — Fatima Farokhrooz
(74) *Attorney, Agent, or Firm* — Tope-McKay & Associates; Autumn Villarreal

(57) ABSTRACT

The present invention relates to a coaxial waveguide electrodeless lamp. The lamp is formed in analogy to coaxial waveguide cables, with an outer conductor, a central conductor, and a gas-fill vessel made of dielectric material between the outer conductor and the inner conductor. The gas-fill vessel is substantially hollow and filled with substances that form a plasma and emit light when RF radiation carried by the central conductor and ground conductor interacts with the substances in the gas-fill vessel. The present invention also relates to a leaky waveguide electrodeless lamp. The lamp is formed in analogy to leaky waveguides, with a conductor, a ground conductor, and a gas-fill vessel made of dielectric material butted against the conductor and encompassed by the ground conductor. The leaky waveguide electrodeless lamp emits light from a plasma similar to light-emission action of the coaxial waveguide electrodeless lamp described above.

25 Claims, 14 Drawing Sheets

U.S. PATENT DOCUMENTS

| | | | | |
|---|---|---|---|---|
| 5,013,976 | A * | 5/1991 | Butler | 315/248 |
| 6,018,218 | A | 1/2000 | Terada et al. | |
| 6,086,258 | A * | 7/2000 | Cadle et al. | 384/294 |
| 6,737,809 | B2 | 5/2004 | Espiau et al. | |
| 2001/0035720 | A1 | 11/2001 | Guthrie et al. | |
| 2003/0117074 | A1 * | 6/2003 | Lapatovich et al. | 313/634 |
| 2005/0029947 | A1 | 2/2005 | Kraus et al. | |

FOREIGN PATENT DOCUMENTS

| | | | |
|---|---|---|---|
| GB | 2 413 005 | A | 10/2005 |
| JP | 2006 040867 | A | 2/2006 |
| WO | WO 2004/059694 | A | 7/2004 |
| WO | WO 2006/006129 | A | 1/2006 |

OTHER PUBLICATIONS

PCT International Preliminary Report on Patentability for PCT/US2006/038787.

PCT International Search Report and the Written Opinion of the International Searching Authority for PCT/US2007/007696.

PCT International Preliminary Report on Patentability for PCT/US2007/007696.

1st Office Action for Chinese Patent Application No. 200680036692.9.

Response to 1st Office Action for Chinese Patent Application No. 200680036692.9.

Notification for the Grant of Invention Patert Right (Notice of Allowance) for Chinese Patent Application No. 200680036692.9.

* cited by examiner

COAXIAL WAVEGUIDE ELECTRODELESS LAMP

PRIORITY CLAIM

The present invention is a non-provisional patent application, claiming the benefit of priority of U.S. Provisional Application No. 60/786,260, filed on Mar. 28, 2006, entitled "Coaxial Waveguide Electrodeless Lamp." The present invention further claims priority of U.S. Provisional Application No. 60/786,995, filed on Mar. 30, 2006, entitled "Electromagnetic Interference (EMI) Shielding of Electrodeless Lamps Using Cutoff Waveguides."

FIELD OF THE INVENTION

The present invention relates to devices and methods for generating light using electrodeless lamps and, more particularly, to lamps driven by a radio-frequency source without the use of internal electrodes.

BACKGROUND OF THE INVENTION

Plasma lamps (such as high intensity discharge (HID) lamps and fluorescent lamps) provide extremely bright, broadband light. Plasma lamps are useful in applications such as projection systems, industrial processing, and general industrial and commercial illumination. Typical plasma lamps contain a mixture of a noble gas (such as Argon) and trace substances (such as metal halide salt or mercury) that are excited to form a plasma. Interaction between the ionized noble gas and the trace substance gives rise to light in the ultraviolet (UV), visible, and near infrared spectrums. Gas ionization resulting in plasma formation is accomplished by applying a high voltage across electrodes; these electrodes are contained within the vessel that serves as the reservoir of the gas fill. However, this arrangement suffers from electrode deterioration due to sputtering of the metal electrodes, and therefore exhibits a limited lifetime. In addition, the presence of metal electrodes inside the gas-fill vessel limits the range of noble gas and metal halide salt that can be used.

Electrodeless plasma lamps driven by microwave sources have been disclosed in prior art for more reliable longer lasting lamps. Various methods have been disclosed to couple radio-frequency (RF) energy into the bulb to ionize the gas without the use of any electrodes inside the bulb (vessel). U.S. Pat. No. 2,624,858 (issued to Greenlee, et al.) and U.S. Pat. No. 6,858,985 B2 (issued to Kraus et al.) disclose capacitively coupled electrodeless lamps. FIG. 1 shows an example of the prior art, which is an electrodeless lamp 100 with capacitive coupling. The electrodeless lamp comprises an enclosed glass tube or quartz tube 104 (gas-fill vessel) filled with an inert gas (Argon, etc.) and metal halide salt material (Selenium, etc.). The quartz tube has an outer diameter between approximately 4 millimeters (mm) and 100 mm, and a length of approximately 6 mm and 500 mm. External to the bulb at both ends are two coupling-in structures 102 and 102' made from highly conductive metal (such as copper with an added thin layer of a high a melting-point metal or a thin layer of dielectric to act as a diffusion barrier between copper and quartz) that applies the RF field to the bulb using capacitive coupling. Depending on the area of the coupling-in structures 102 and 102' and the size of the bulb, the RF source can have a frequency range approximately between 1 megahertz (MHz) and 10 GHz for optimum coupling of the RF energy into the bulb. The RF energy ionizes the gas inside the bulb 104 and vaporizes/melts the salt material. The interaction between the ionized gas and salt vapor produces an intense source of light 106. Depending on the inert gas and salt material, different emission spectra can be produced from the lamp 100.

The prior art shown in FIG. 1 consist of a quartz bulb (or a tube of glass) filled with a noble gas and metal halide salt material (Selenium or other). Electrodes, external to the bulb, apply a high energy RF field to the gas to ionize it. The ionized gas will in turn heat the salt material to melt/vaporize it. Interaction between the ionized noble gas and the salt vapor results in high intensity illumination from the bulb. Because electrodes are external to the bulb, these types of bulbs do not have the reliability issues associated with electrode degradation as a result of exposure to plasma and salt material in conventional plasma lamps. The coupling efficiency of the RF to the plasma, which is a critical parameter for overall efficiency of the lamp, depends on the impedance of the capacitive coupling-in structures. This impedance depends inversely on the frequency of the RF source and the coupling capacitance of the external electrodes. For a number of applications it is desirable to use a lower frequency RF source, particularly to lower the cost of the lamp. However, the size of the bulb and the electrodes can limit the frequency of the RF source to frequencies in the low gigahertz (GHz) range. In addition, for longer bulbs the separation between coupling-in electrodes will increase, reducing the strength of the electric field. Thus, for this type of electrodeless lamp the number of design parameters to optimize the performance and cost of the lamp is limited.

Microwave discharge type electrodeless lamps have been disclosed in U.S. Pat. No. 6,617,806B2 (issued to Kirkpatrick et al.) and U.S. Pat. No. 6,737,809B2 (issued to Espiau et al.). These inventions disclose similarly basic configurations of a gas fill encased in either a bulb or a sealed recess within a dielectric body to form a waveguide or a resonator. Microwave energy from a source, such as a magnetron or a microwave solid state power amplifier, is introduced into the waveguide. The microwave energy is then coupled into the bulb to heat the plasma and metal halide salt material. The prior art disclosed in U.S. Pat. No. 6,737,809B2 is shown in FIG. 2. FIG. 2 is a schematic of another example of prior art: a microwave discharge electrodeless lamp 200. A gas-fill vessel (bulb) 206 made from quartz is filled with an inert gas (Argon, etc.) and salt material (Selenium, etc.). The bulb is placed inside an opaque dielectric waveguide 202 (resonator/cavity) with only the tip of the bulb being outside the dielectric. The dielectric waveguide 202 is made from a higher dielectric constant material (such as alumina) compared to quartz. The size of the dielectric waveguide 202 is comparable to the wavelength of the RF frequency source exciting the plasma. The typical diameter of the dielectric waveguide 202 is about half the wavelength (inside the dielectric waveguide 202) of the RF source. The RF source is coupled into the dielectric using an RF probe 204 and it is coupled out using RF probe 204' through the back of the dielectric waveguide. The dielectric waveguide 202 couples the RF into the bulb 206 to ionize the gas and melt/vaporize the salt. The interaction between the ionized gas and salt vapor causes light emission 208 from the bulb 206. The light is only emitted from the top of the lamp 200 only since it is surrounded with opaque dielectric 202 on the sides. In some cases, the dielectric wall surrounding the bulb 206 is coated with a reflective surface to increase the amount of light that is harvested from the lamp 200.

FIG. 3 is a schematic of the prior art, shown as a cross-section of the lamp of FIG. 2, with the cross-section being taken through approximately the middle of the lamp 200. In this example, the dielectric waveguide (resonator/cavity) 202 surrounds the gas-fill vessel (bulb) 206 coupling RF energy to create plasma inside the bulb causing light emission 208 from the bulb 206.

Most of the quartz bulb, except for a small portion of the tip, is enclosed within an opaque dielectric waveguide. RF energy is applied to the dielectric waveguide (or resonator) through the back of the dielectric via an RF probe. The light is "harvested" from the top of the dielectric. To operate the lamp at lower frequencies and achieve the same coupling efficiency achieved at higher frequencies, the size of the dielectric waveguide/resonator has to be increased. However, in a number of applications the overall size of the lamp that can be used is limited; so the size of the dielectric—and therefore the frequency of operation—will be limited as well. In addition, scaling the lamp to get a higher light output power is difficult with this design.

The above-described prior art and their associated problems clearly demonstrate a need for an electrodeless plasma lamp that is efficient, robust, and easily scalable to both different sizes and different frequency ranges of RF sources.

SUMMARY OF THE INVENTION

The present invention relates to a coaxial waveguide electrodeless lamp that encompasses a very broad class of shapes. The lamp comprises a gas-fill vessel, a central conductor, an outer conductor, and a gas-fill inside the gas-fill vessel. The gas-fill vessel is substantially in the shape of a tube with a cross-section. The gas fill vessel itself comprises: a first end; a second end; an outer surface, the outer surface being substantially transparent or substantially translucent; an inner surface, the inner surface substantially transparent or substantially translucent; a first cap on the first end; a second cap on the second end; a closed cavity bounded by the outer surface, the inner surface, the first cap and the second cap; a hollow core bounded by the inner surface; a length from the first end to the second end; and a long axis. The central conductor has a length and a shape substantially similar to the hollow core of the gas-fill vessel. The central conductor also has a long axis substantially parallel to the long axis of the gas-fill vessel. The central conductor fits substantially within the hollow core of the gas-fill vessel for at least a portion of the length of the central conductor. The outer conductor is substantially transparent or substantially translucent. The outer conductor is a substantially thin tube and is substantially in the shape of the outer surface of the gas-fill vessel. The outer conductor has a length and a long axis substantially parallel to the long axis of the inner conductor and substantially parallel to the long axis of the gas-fill vessel. The outer conductor fits substantially around the gas-fill vessel for at least a portion of the length of the outer conductor. The gas-fill contained inside the closed cavity of the gas-fill vessel comprises at least one substance selected from the group consisting of gas, liquid, and solid. The coaxial waveguide electrodeless lamp emits light through the outer conductor when electromagnetic radiation carried by the outer conductor and the central conductor interacts with the gas-fill.

In yet another aspect, the coaxial waveguide electrodeless lamp described above has a gas-fill vessel with a cross-section that is substantially a rectangular annulus.

In yet another aspect, the coaxial waveguide electrodeless lamp described above has a gas-fill vessel with a cross-section that is substantially a square annulus.

The present invention also relates to a coaxial waveguide electrodeless lamp that has a shape comprising a series of substantially concentric cylinders. The coaxial waveguide electrodeless lamp comprises a gas-fill vessel, a central conductor, an outer conductor, and a gas-fill inside the gas-fill vessel. The gas-fill is substantially in the shape of an annular cylinder. The gas fill-vessel is substantially hollow. The gas-fill vessel is also substantially transparent or substantially translucent. The gas-fill vessel further comprises: a first end; a second end; an outer diameter; an inner diameter; a first annular cap on the first end; a second annular cap on the second end; a closed cavity defined by the outer diameter, the inner diameter, the first annular cap and the second annular cap; a hollow core bounded by the inner diameter; a length from the first end to the second end; and a long axis. The central conductor that is substantially cylindrical has a length. The central conductor has a diameter substantially similar to the inner diameter of the gas-fill vessel. The central conductor also has a long axis substantially parallel to the long axis of the gas-fill vessel. The central conductor fits substantially within the hole of the gas-fill vessel for at least a portion of the length of the central conductor. The outer conductor is substantially transparent or substantially translucent. The outer conductor is substantially in the shape of a cylindrical shell. The outer conductor has a length and a long axis substantially parallel to the long axis of the central conductor and substantially parallel to the long axis of the gas-fill vessel. The outer conductor has a diameter substantially similar to the outer diameter of the gas-fill vessel. The outer conductor fits substantially around the gas-fill vessel for at least a portion of the length of the outer conductor. The gas-fill is contained inside the closed cavity of the gas-fill vessel. The gas-fill comprises at least one substance selected from the group consisting of gas, liquid, and solid. The coaxial waveguide electrodeless lamp emits light through the outer conductor when electromagnetic radiation carried by the outer conductor and the central conductor interacts with the gas-fill.

In yet another aspect, in the coaxial waveguide electrodeless lamp described above, the outer conductor comprises: a conductive layer that is substantially transparent or substantially translucent; and a substrate layer that is substantially transparent or substantially translucent, the substrate layer in intimate contact with the conductive layer, whereby the substrate layer provides structural support for the conductive layer.

In yet another aspect, in the coaxial waveguide electrodeless lamp described above the center conductor is made from a conductive metal.

In yet another aspect, in the coaxial waveguide electrodeless lamp described above, the lamp is electrically terminated by a load, short, or open circuit to maximize light output.

In yet another aspect, in the coaxial waveguide electrodeless lamp described above, the gas-fill comprises at least one inert gas and at least one fluorophor.

In yet another aspect, in the coaxial waveguide electrodeless lamp described above, the gas-fill comprises at least one inert gas.

In yet another aspect, in the coaxial waveguide electrodeless lamp described above, the gas-fill vessel is made of quartz, fused silica, or glass.

In yet another aspect, in the coaxial waveguide electrodeless lamp described above, at least a portion of the gas-fill vessel has a refractory veneer, whereby the refractory veneer prevents diffusion of impurities into the gas-fill vessel.

In yet another aspect, in the coaxial waveguide electrodeless lamp described above, the lamp is substantially in the shape of a "U" having a substantially cylindrical cross-section, the lamp having at least one RF input.

In yet another aspect, in the coaxial waveguide electrodeless lamp described above, the lamp is substantially in the shape of a torus having a substantially cylindrical cross-section, the lamp having at least one RF input.

In yet another aspect, in the coaxial waveguide electrodeless lamp described above, the outer conductor is a mesh, the mesh substantially transparent and made from a conducting metal, where the percentage of open area of the mesh is substantially high to make the mesh substantially transparent without substantially compromising the conductivity of the outer conductor.

In yet another aspect, in the coaxial waveguide electrodeless lamp described above, a portion of the mesh is replaced by a solid metal sheet of substantially the same shape as the portion of the mesh that is replaced. The solid metal sheet is made from a substantially conductive, substantially reflective material. The solid metal sheet acts as a heat sink and a also as a mirror, providing directional light output.

In yet another aspect, in the coaxial waveguide electrodeless lamp described above, the solid metal sheet replaces approximately 180 degrees of the mesh for at least a portion of the length of the outer conductor.

In yet another aspect, in the coaxial waveguide electrodeless lamp described above, the outer conductor is made of a conductive material that is substantially transparent or substantially translucent.

In yet another aspect, in the coaxial waveguide electrodeless lamp described above, a portion of the conductive material is coated with a frequency-conversion material, whereby the frequency-conversion material converts light emitted by the gas-fill to light of other frequencies.

In yet another aspect, in the coaxial waveguide electrodeless lamp described above, a portion of the conductive material is coated with a reflective material, providing directional light output.

In yet another aspect, in the coaxial waveguide electrodeless lamp described above, the reflective material is a dielectric mirror or a substantially reflective metal.

In yet another aspect, in the coaxial waveguide electrodeless lamp described above, 180 degrees of the conductive material is coated with the reflective material.

In yet another aspect, the coaxial waveguide electrodeless lamp described above includes the following further limitations: the coaxial waveguide electrodeless lamp further comprises a dielectric-enhancing layer, the dielectric-enhancing layer being made of a material with dielectric constant of at least two and being shaped substantially as an annular cylinder with an inner diameter, an outer diameter, and a long axis substantially parallel to the long axis of the center conductor; the inner diameter of the gas-fill vessel is substantially similar to the outer diameter of the dielectric-enhancing layer, rather than the outer diameter of the center conductor; the outer diameter of the center conductor is substantially similar to the inner diameter of the dielectric-enhancing layer, rather than the inner diameter of the gas-fill vessel; and the dielectric-enhancing layer fits substantially between the gas-fill vessel and the center conductor. Thus the dielectric-enhancing layer serves to optimize RF-electrical properties of the coaxial waveguide electrodeless lamp described above.

In yet another aspect, in the coaxial waveguide electrodeless lamp described above, the dielectric-enhancing layer is made from sapphire or substantially translucent alumina.

In yet another aspect, the coaxial waveguide electrodeless lamp described above includes the following further limitations: the coaxial waveguide electrodeless lamp further comprises a dielectric-enhancing layer, the dielectric-enhancing layer being made of a substantially transparent or substantially translucent material with dielectric constant of at least two, and being shaped substantially as an annular cylinder with an inner diameter, an outer diameter, and a long axis substantially parallel to the long axis of the center conductor; the outer diameter of the gas-fill vessel is substantially similar to the inner diameter of the dielectric-enhancing layer, rather than the diameter of the outer conductor; the diameter of the outer conductor is substantially similar to the outer diameter of the dielectric-enhancing layer, rather than the outer diameter of the gas-fill vessel; and the dielectric-enhancing layer fits substantially between the gas-fill vessel and the outer conductor. Thus the dielectric-enhancing layer serves to optimize RF-electrical properties of the coaxial waveguide electrodeless lamp.

In yet another aspect, in the coaxial waveguide electrodeless lamp described above, the dielectric-enhancing layer is made from sapphire or alumina.

In yet another aspect, the coaxial waveguide electrodeless lamp described above includes the following further limitations: an RF power source; a power amplifier, the power amplifier being made from solid-state components or equivalents thereof; and a tunable RF coupler, the tunable RF coupler being comprised of a tunable matching network, a tunable resonator, or a combination of tunable matching networks and tunable resonators, whereby RF energy is produced by the RF power source, amplified by the power amplifier, and coupled to the coaxial waveguide electrodeless lamp by the tunable RF coupler.

In yet another aspect, in the coaxial waveguide electrodeless lamp described above, a photodetector is capable of sampling light output from the coaxial waveguide electrodeless lamp and provides a feedback signal to the tunable RF coupler, whereby the tunable RF coupler is tuned to maximize light output.

In yet another aspect, in the coaxial waveguide electrodeless lamp described above, an RF detector is capable of sampling reflected RF power from the coaxial waveguide electrodeless lamp and providing a feedback signal to the tunable RF coupler, whereby the tunable RF coupler is tuned minimize reflected RF power and thus maximize RF power coupled to the coaxial waveguide electrodeless lamp.

The present invention also relates to a leaky waveguide electrodeless lamp that encompasses a very broad class of shapes. The leaky waveguide electrodeless lamp comprises a conductor, a gas-fill vessel, an insulating veneer, a refractory veneer, a ground conductor, and a gas-fill inside the gas-fill vessel. The conductor is substantially in the shape of a tube. The conductor further comprises: a cross-section; a surface; an insulating veneer on the surface; a length; and a long axis. The gas-fill vessel is substantially in the shape of a tube. The gas-fill vessel further comprises: a cross-section having a cut-out portion, the cut-out portion fitting substantially around at least a portion of the cross-section of the central conductor; a first end; a second end; a length from the first end to the second end; a surface substantially defined by translation of the cross-section of the gas-fill vessel along the length of the gas-fill vessel, the surface substantially transparent or translucent; a first cap on the first end; a second cap on the second end; a closed cavity bounded by the surface, the first cap, and the second cap; and a long axis parallel to the long axis of the conductor, the gas-fill vessel making substantially intimate contact with the conductor for at least a portion of the length of the gas-fill vessel. The insulating veneer substantially covers at least the portion of the surface of the conductor that is not in substantially intimate contact with the gas-fill vessel. The refractory veneer is substantially transparent or substantially translucent. The refractory veneer substantially covers at least a portion of the surface of the gas-fill vessel. The ground conductor is substantially transparent or substantially translucent. The ground conductor substantially surrounds the gas-fill vessel and conductor for at least a portion of the length of the conductor. The gas-fill is contained inside the closed cavity of the gas-fill vessel, the gas-fill comprising at least one species selected from the group consisting of gas, liquid, or solid. The coaxial waveguide electrodeless lamp emits light through the ground conductor when electromagnetic radiation carried by the conductor and the ground conductor interacts with the gas-fill.

The present invention also relates to a leaky waveguide electrodeless lamp that has a circular shape, composed of two half-circles, one the gas-fill vessel and the other the conductor. The leaky waveguide electrodeless lamp comprises a conductor, a ground conductor, an insulating veneer, a gas-fill vessel, and a gas-fill inside the gas-fill vessel. The conductor is substantially in the shape of a tube. The conductor further comprises: a cross-section, the cross-section being substantially semi-circular, having a curved portion and a flat portion; a surface having a curved portion defined by the curved portion of the cross-section of the conductor and a flat portion defined by the flat portion of the cross-section of the conductor; an insulating veneer on the surface; a length; and a long axis. The gas-fill vessel is substantially in the shape of a tube. The gas-fill vessel further comprises: a cross-section, the cross-section being substantially semi-circular, having a curved portion and a straight portion; a first end; a second end; a length from the first end to the second end; a surface having a curved portion defined by the curved portion of the cross-section of the gas-fill vessel and a flat portion defined by the flat portion of the cross-section of the gas-fill vessel, the surface substantially transparent or substantially translucent; a first cap on the first end; a second cap on the second end; a closed cavity bounded by the surface of the gas-fill vessel, the first cap, and the second cap; a refractory veneer covering at least a portion of the surface of the gas-fill vessel; and a long axis parallel to the long axis of the conductor. The flat portion of the surface of the gas-fill vessel makes substantially intimate contact with the flat portion of the surface of the conductor for at least a portion of the length of the gas-fill vessel. The insulating veneer substantially covers at least the curved portion of the surface of the conductor. The ground conductor is substantially transparent or substantially translucent. The ground conductor substantially surrounds the curved portion of the surface of the gas-fill vessel and the curved portion of the surface of the conductor for at least a portion of the length of the conductor. The gas-fill is contained inside the closed cavity of the gas-fill vessel. The gas-fill comprising at least one substance selected from the group consisting of gas, liquid, or solid. The coaxial waveguide electrodeless lamp emits light through the ground conductor when electromagnetic radiation carried by the conductor and the ground conductor interacts with the gas-fill.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
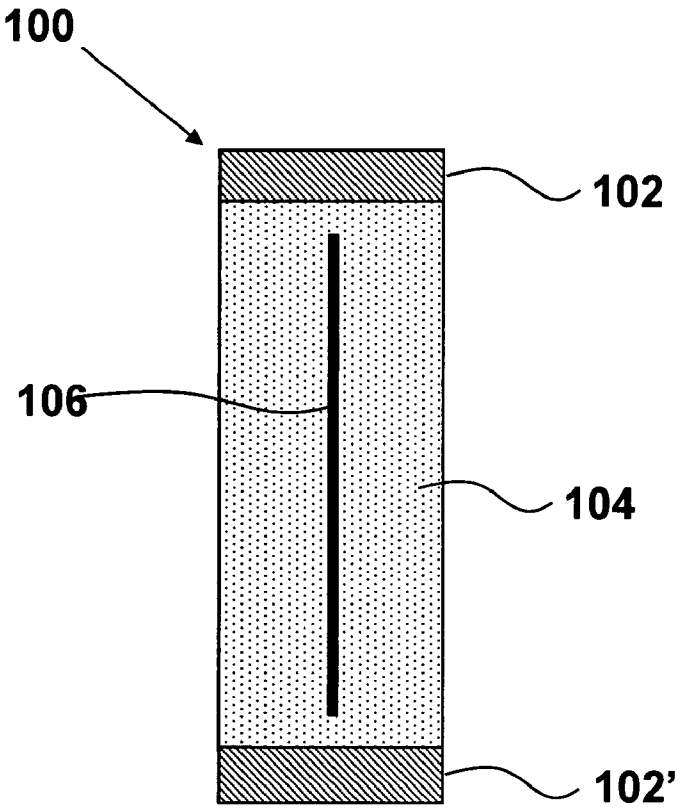
FIG. 1 (Prior Art)
FIG. 1 is a schematic of a capacitively coupled (E discharge) electrodeless lamp according to the prior art.
Figures 2, 3:
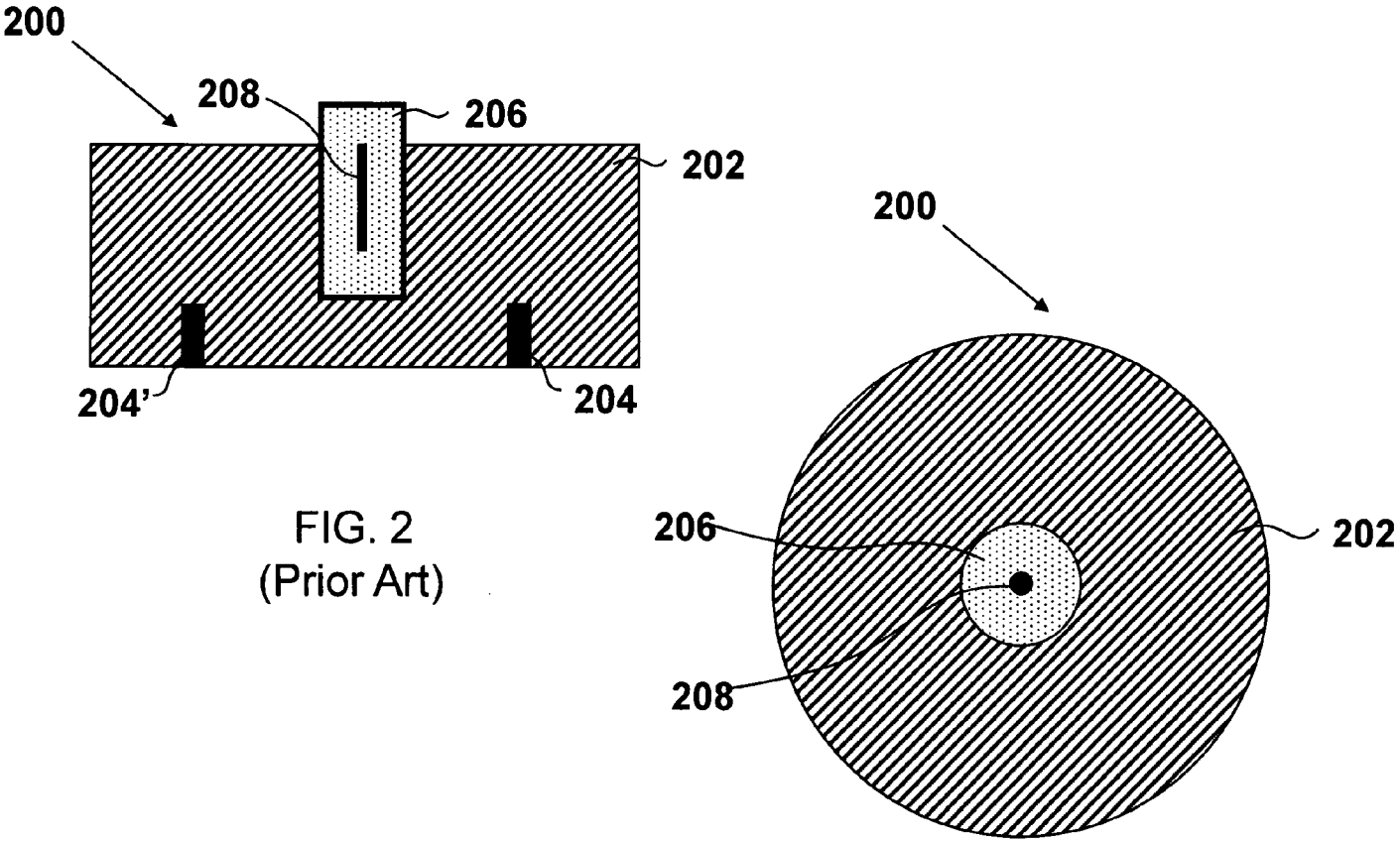
FIG. 2 (Prior Art)
FIG. 3 (Prior Art)
FIG. 2 is a schematic of a microwave discharge electrodeless lamp according to the prior art.
FIG. 3 is a schematic of cross-section of the lamp shown in FIG. 2.

The present invention relates to devices and methods for generating light and, more particularly, to the field of electrodeless lamps. Further, the present invention relates to lamps driven by a radio-frequency source without the use of internal electrodes. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Glossary

Before describing the specific details of the present invention, a glossary is provided in which various terms used herein and in the claims are defined. The glossary provided is intended to provide the reader with a general understanding of the intended meaning of the terms, but is not intended to convey the entire scope of each term. Rather, the glossary is intended to supplement the rest of the specification in more accurately explaining the terms used.

Annulus—The term "annulus" as used with respect to this invention refers to a two-dimensional geometric shape defined by two concentric circles with different diameters; the annulus is the region bounded by (between) the two circles.

Annular Cylinder—The term "annular cylinder" as used with respect to this invention is the three-dimensional analogue of an annulus; i.e. an annulus is the cross-section of an annular cylinder. An annular cylinder is completely defined by two diameters and a length. A hollow, circular pipe is a non-limiting example of an annular cylinder. A closed annular cylinder is an annular cylinder with each of its two ends "capped" by an annulus substantially identical to the annulus that forms the cross-section of the annular cylinder. An annular cylinder that is not specifically referred to as closed may still be closed.

Conductor—The term "conductor" as used with respect to this invention refers to a material that conducts electricity without suffering high loss. Non-limiting examples of metal conductors are silver, platinum, copper, gold and aluminum; non-limiting examples of transparent conductors are Indium-Tin Oxide, Zinc Oxide and Nickel Oxide. As can be appreciated by one skilled in the art, conductors are not limited to the species listed above (i.e. metals and transparent conductors).

Dielectric Constant—The term "dielectric constant" as used with respect to this invention refers to the relative permittivity of the material, where the relative permittivity has the usual meaning used in electrodynamics.

Distributed Structure—The term "distributed structure" as used with respect to this invention refers to an RF/microwave structure, the dimensions of which are comparable to the wavelength of the frequency source. This could be a length of a transmission line or a resonator.

Frequency-Conversion—The term "frequency-conversion" as used with respect to this invention refers to the process of converting light of a particular frequency or spectrum of frequencies to light of other frequencies. A frequency-conversion material is a material capable of frequency conversion. Frequency conversion can reduce the frequency of light, non-limiting examples of which include the coating on conventional fluorescent mercury lamps which converts far and near ultra-violet light to a "white" spectrum of visible light. Alternatively, frequency-conversion can increase the frequency of light, a non-limiting example of which is multi-photon absorption materials used to convert infra-red light to visible light, non-limiting examples of which are erbium-doped lanthanum-oxide chalcogenide glass or typical phosphorescent materials used to view infra-red laser beams.

Fluorescence—The term "fluorescence" as used with respect to this invention refers to the emission of radiation associated with the relaxation of an atom or molecule from an excited energy level to a lower (usually ground state) level.

Fluorophor—The term "fluorophor" as used with respect to this invention refers to a material that undergoes fluorescence (see above definition of fluorescence).

Intimate Contact—The term "intimate contact" as used with respect to this invention refers to two surfaces with no significant gap between them.

Lumped Circuit—The term "lumped circuit" as used with respect to this invention refers to a circuit comprising actual resistors, capacitors and inductors as opposed to, for example, a transmission line or a dielectric resonator (circuit components that are comparable in size to the wavelength of the RF source).

Matching Network—The term "matching network" as used with respect to this invention refers to a circuit that matches the impedance of an input to a load. Matching networks may be comprised of lumped circuit elements, distributed structures, or both. A tunable matching network is a matching network that has the capability of being optimized for power transfer over a range of frequencies by changing some parameter of the matching network to correspond to a particular frequency within the range.

Parasitics—The term "parasitics" as used with respect to this invention refers to non-idealities in the components, in this case, used to distribute energy. These are "extra" resistances, capacitances and inductances of the components that effectively waste the power of the RF/microwave source.

Percentage of Open Area—The term "percentage of open area" as used with respect to this invention refers to the ratio of the surface area of holes to the total surface area of a mesh. A percentage of open area of 0% indicates solid material (no holes).

Rectangular Annulus—The term "rectangular annulus" as used with respect to this invention refers to the two-dimensional geometric shape formed by any two rectangles that satisfy the following properties: one rectangle fits inside the other rectangle, and the two rectangles do not touch. The rectangular annulus is the region bounded by (between) the two rectangles.

RF-Electrical Properties—The term "RF-Electrical Properties" as used with respect to this invention refers to the conductance, capacitance, and inductance per unit length of a material at RF frequencies of electromagnetic radiation.

Refractory—The term "refractory" as used with respect to this invention refers to a material having the ability to retain its physical shape and chemical identity when subjected to high temperatures.

Square Annulus—The term "square annulus" as used with respect to this invention refers to the two-dimensional geometric shape formed by circumscribing two squares around any two circles that form an annulus (see Annulus). The square annulus is the region bounded by (between) the two squares.

Translucent—The term "translucent" as used with respect to this invention refers to a material that transmits a substantial fraction of the light that impinges but transmitted light is made substantially diffuse by the material; i.e. images cannot be formed on either side of a translucent material, even though the material does not significantly absorb the light.

Transparent—The term "transparent" as used with respect to this invention refers to a material that transmits a substantial fraction of the light that impinges upon it without substantially scattering the light; i.e. images can be formed on either side of a transparent material.

Tube—The term "tube" as used with respect to this invention refers to a hollow body with an arbitrary cross-section that carries approximate cylindrical symmetry in the sense that its cross-section does not vary rapidly over length scales that are short compared to its length. A thin tube is a tube whose walls are much thinner than the dimensions of its cross-section.

Veneer—The term "veneer" as used with respect to this invention refers to a face or cover on an object made from any material that is more desirable as a surface material than the basic material of the object.

(2) Introduction to Coaxial Waveguides

Coaxial waveguides are used in a number of applications including transport of cable television (TV) and interne signals to homes. Coaxial waveguides have distinct advantages over other types of waveguides; these advantages include having very broadband transverse-electromagnetic (TEM) modes that propagate in addition to working down to direct current (DC) voltages. Four equations that are useful for coaxial waveguides are:

$$Z_0 = \frac{138}{\sqrt{\varepsilon_r}}\log\left(\frac{D}{d}\right)(ohms)$$

$$f_c = \frac{11.8}{\pi\left(\frac{D+d}{2}\right)\sqrt{\varepsilon_r}}(\text{GHz})$$

$$C = \frac{7.354\varepsilon_r}{\log\left(\frac{D}{d}\right)}(\text{pF/ft})$$

$$L = 0.1404\log\left(\frac{D}{d}\right)\ (nH/\text{ft})$$

Here, $Z_0$ is the characteristic impedance in Ohms, $f_c$ is the cutoff frequency in gigahertz, $\epsilon_r$ is the dielectric constant of the dielectric layer, C is the capacitance in picofarads per foot and L is the inductance nanohenrys per foot. The two diameters are labeled as follows: D is the diameter of the dielectric, and d is the diameter of center conductor, both in inches. Based on these equations, one can see that by proper selection of the various parameters it is possible to design a wide range of characteristic impedances, per-length capacitances, per-length inductances, and cutoff frequencies for the coaxial waveguide.

For coaxial waveguides, $f_c$ does not indicate a lower cutoff frequency limit for propagation of signals as it does for rectangular and circular waveguides. For coaxial waveguides, $f_c$ refers to the frequency above which higher-order modes are allowed to propagate. Higher-order modes will be excited at small imperfections, bends, etc., and will propagate with a different phase velocity and interfere with the TEM mode. If the dielectric material is lossy, the dielectric conductance G (which depends on the loss-tangent of the dielectric) will impact the characteristic impedance of the waveguide and the propagation characteristics. For a lossy dielectric, the propagation characteristic, β, and characteristic impedance, $Z_0$, are given by the following equations.

$$\beta^2 = \omega^2 LC\left(1 - \frac{jG}{\omega C}\right)\ Z_o = \sqrt{\frac{j\omega L}{j\omega C + G}}$$

(3) Detailed Description of the Drawings

Figure 4:
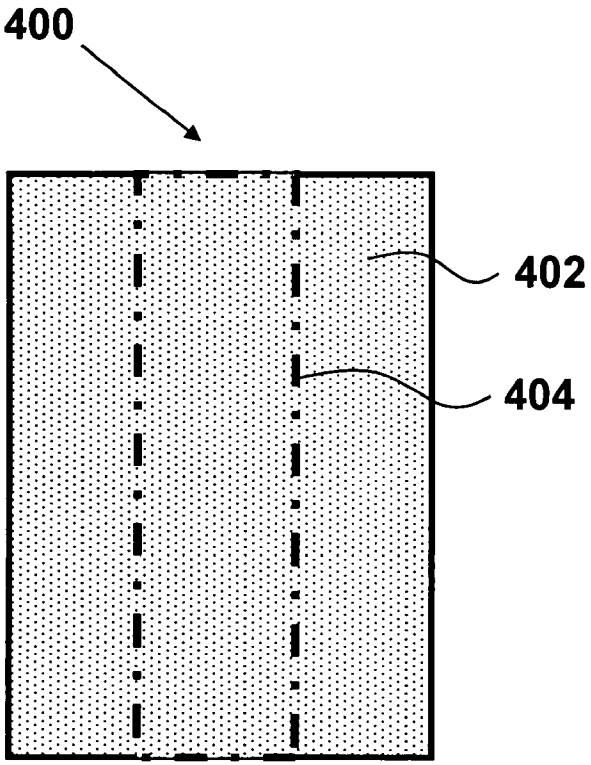
FIG. 4 is a top-view of a gas-fill vessel (bulb) used in a coaxial waveguide lamp according to the present invention.

FIG. 4 depicts the top-view of the gas-fill vessel (bulb) of the present invention. The gas-fill vessels can be made from quartz, glass or a similar material. The bulb is made in the shape of an annular cylinder (elongated donut). For example, the bulb is shown as a quartz annular cylinder 402 with a circular hole 404 through the center of the cylinder. The bulb is filled with at least one inert gas (Argon, etc.) and one metal halide salt or light emitter (Selenium, mercury, etc.). The outer diameter of the annular cylinder is in the range of approximately 6 mm to 200 mm and the center hole has a diameter in the rage of approximately 2 mm to 100 mm depending on the size of the quartz cylinder.

Figure 5:
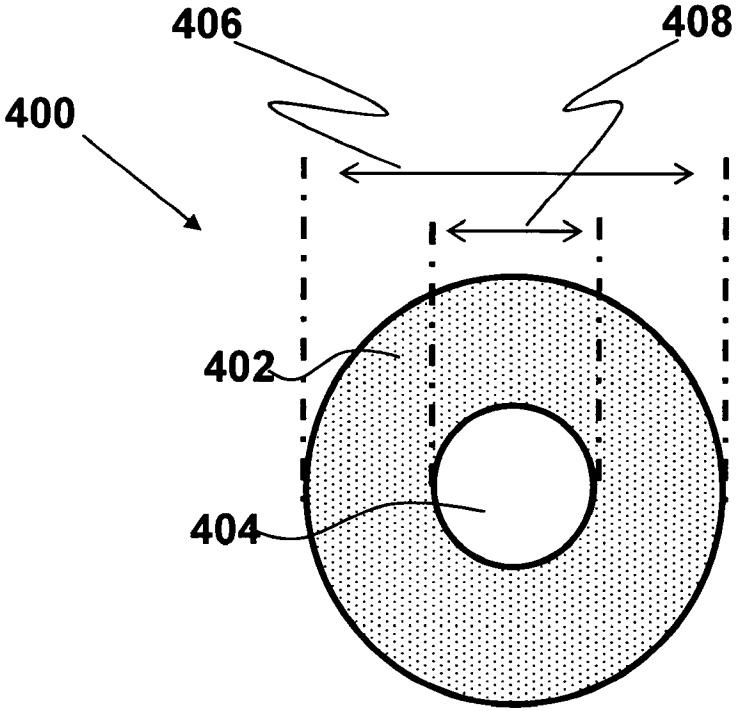
FIG. 5 is a cross-sectional, side view of the gas-fill vessel of FIG. 4.

FIG. 5 is a schematic of the cross-section of the bulb shown in FIG. 4, showing the annular cylinder 402 with a hollow core 404 or hole through the center of the cylinder. The annular cylinder 402 is defined by the outer diameter 406 and inner diameter 408.

Figure 6:
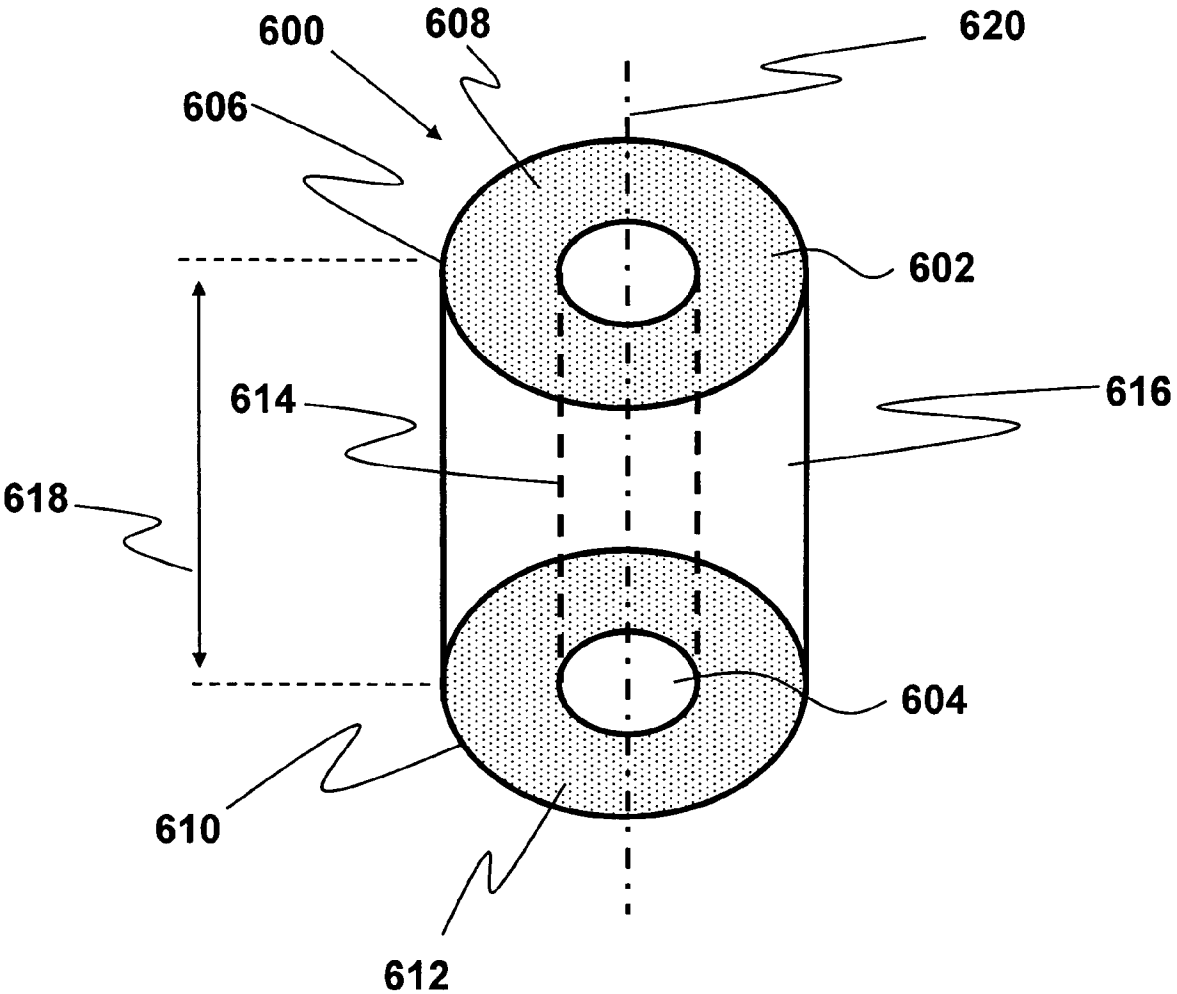
FIG. 6 is a three-dimensional perspective view of the gas-fill vessel of FIG. 4.

FIG. 6 depicts a three-dimensional view of the gas-fill vessel of FIG. 4 and FIG. 5. FIG. 6 illustrates that the gas-fill vessel 600 is in the shape of an annular cylinder (elongated donut). It includes a closed cavity 602 that is substantially in the shape of an annular cylinder, made of, for example, quartz that has a hollow core 604 in the form of a smaller hollow cylinder. The gas-fill vessel 600 has a first end 606 with an annular first end cap 608 and a second end 610 with an annular second end cap 612. The inner surface 614 and outer surface 616, along with the first end cap 608 and the second end cap 612, bound the closed cavity 602. The gas-fill vessel 600 also has a length 618 between the first end 606 and the second end 610. A long axis 620 runs down the center of the gas-fill vessel 600; this long axis 620 also serves as the long axis for the inner conductor, the outer conductor and any dielectric-enhancing layers. Before being sealed, the closed cavity 602 is filled with an inert gas and metal halide salt.

Figure 7:
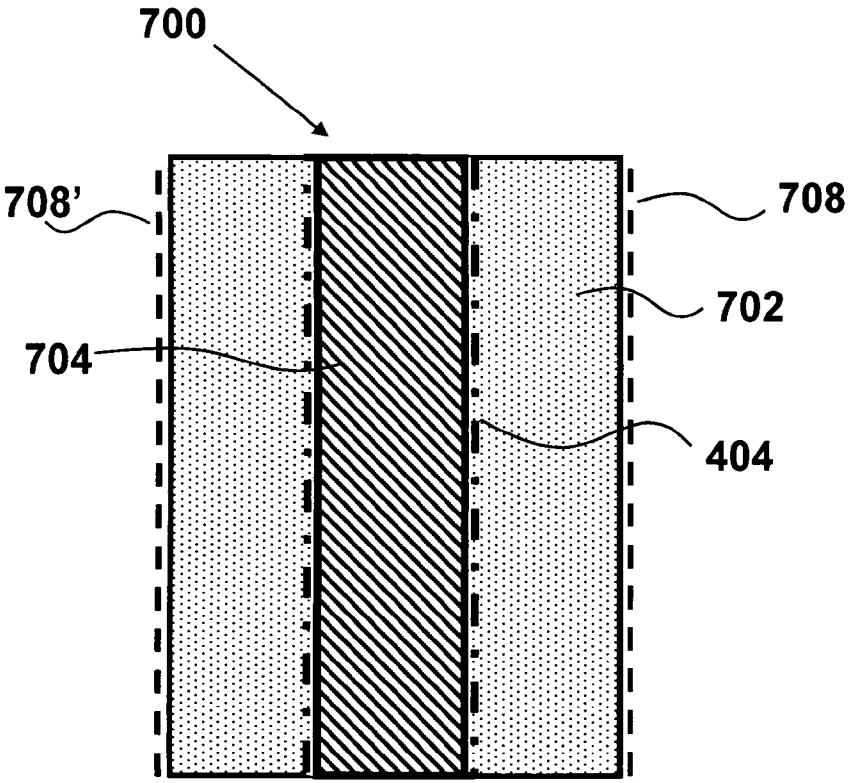
FIG. 7 is an illustration of an external electrode that acts as the center conductor of a coaxial waveguide to excite the plasma in the gas-fill vessel in the shape of a cylinder with a hole in the center, according to the present invention.

FIG. 7 depicts one aspect of the invention in which an external electrode that forms the center conductor 704 is made from copper (or a similar metal) with an added thin layer of high a melting-point metal to act as diffusion barrier between quartz and copper. The center conductor 704 of the waveguide 700 is in the form of a wire/rod passing through the hollow cavity 404. A substantially transparent or translucent outer conductor 708 and 708', which can take the form of a wire-mesh or transparent/translucent conductive material surrounds the outside wall of the quartz bulb 702 to form the shield or ground conductor 708 and 708' of the coaxial waveguide 700. Outer conductors made from wire mesh have a high percentage of open area; a non-limiting examples of a transparent/translucent material is Indium-Tin Oxide. An RF source, connected between the center conductor 704 and the ground conductor 708 and 708', ionizes the noble gas in the bulb 702 and melts/vaporizes the metal halide salt to cause light emission from the bulb 702.

Figure 8:
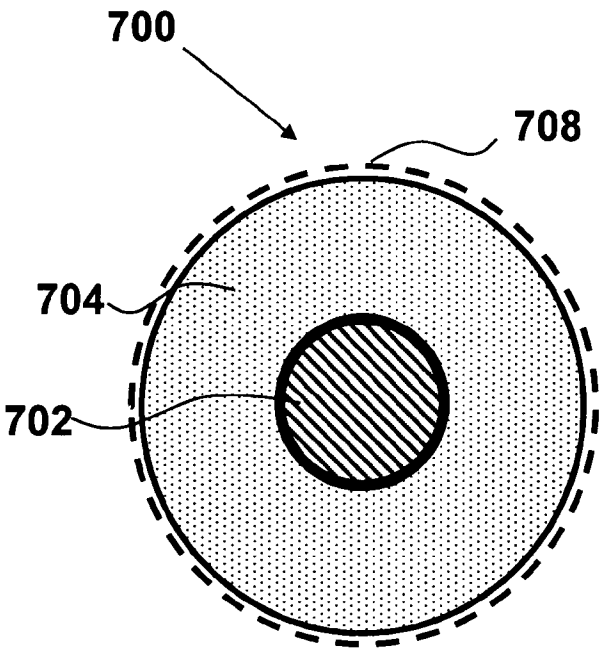
FIG. 8 is a cross-sectional view of the lamp shown in FIG. 7.

FIG. 8 is a schematic of the cross-section of the lamp in FIG. 7, showing the center conductor 704, the annular cylinder-shaped bulb 702, and the outer conductor 708.

Figure 9:
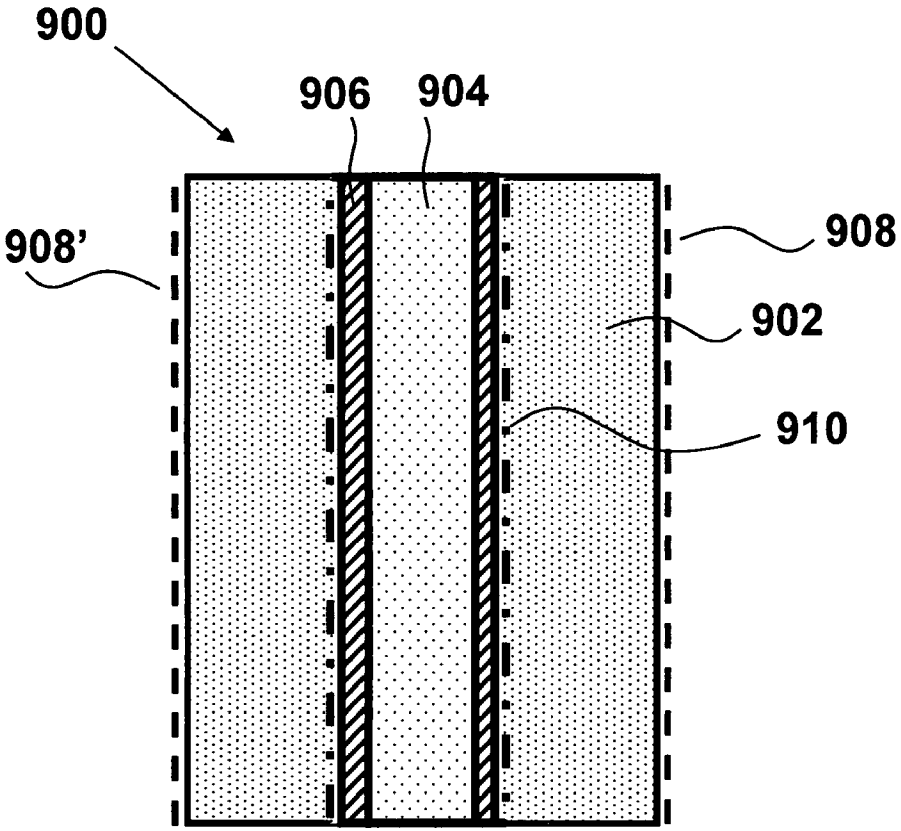
FIG. 9 is an illustration of another embodiment of the invention in which a layer of dielectric that is inserted between the center electrode of the coaxial waveguide and the gas-fill vessel, according to the present invention.

FIG. 9 depicts another aspect of the present invention. Ash shown in FIG. 9, a dielectric layer 906 (made from a translucent or transparent dielectric material with a dielectric constant of approximately 2 or higher, a non-limiting example of which is alumina) in the shape of a ring surrounds the center conductor 904. The dielectric layer 906 fits through the hollow cavity 910 of the bulb 902. A wire-mesh 908 and 908' surrounds the bulb 902 and acts as the outer conductor (shield or ground plane) for the coaxial waveguide. The dielectric layer 906 improves coupling of the RF energy into the bulb 902 and adds flexibility in the design parameters to optimize the performance of the lamp 900.

Figure 10:
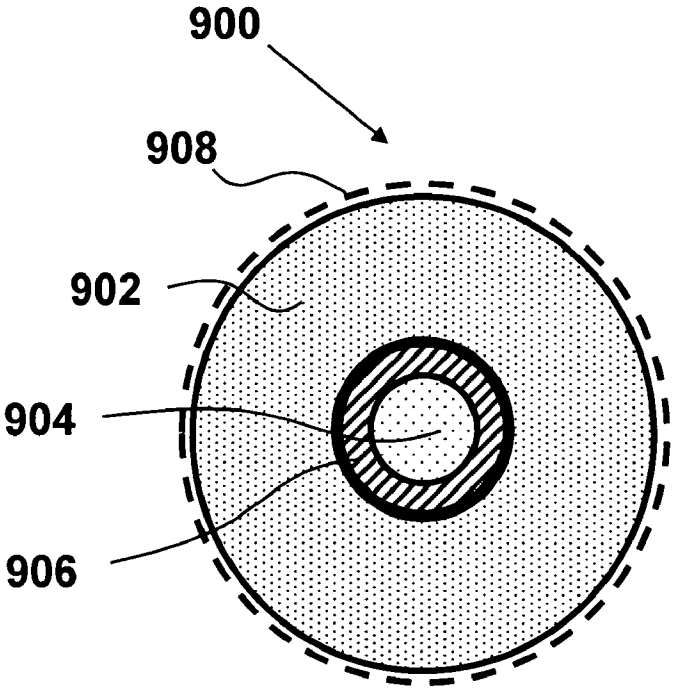
FIG. 10 is a cross-sectional view of the lamp shown in FIG. 9.

FIG. 10 is a schematic of the cross-section of the lamp 900 in FIG. 9, showing the center conductor 904, the dielectric layer 906, the annular cylinder-shaped gas-fill vessel 902 (quartz donut shaped-bulb), and the outer conductor 908 (wire-mesh grid ground, for example).

Figure 11:
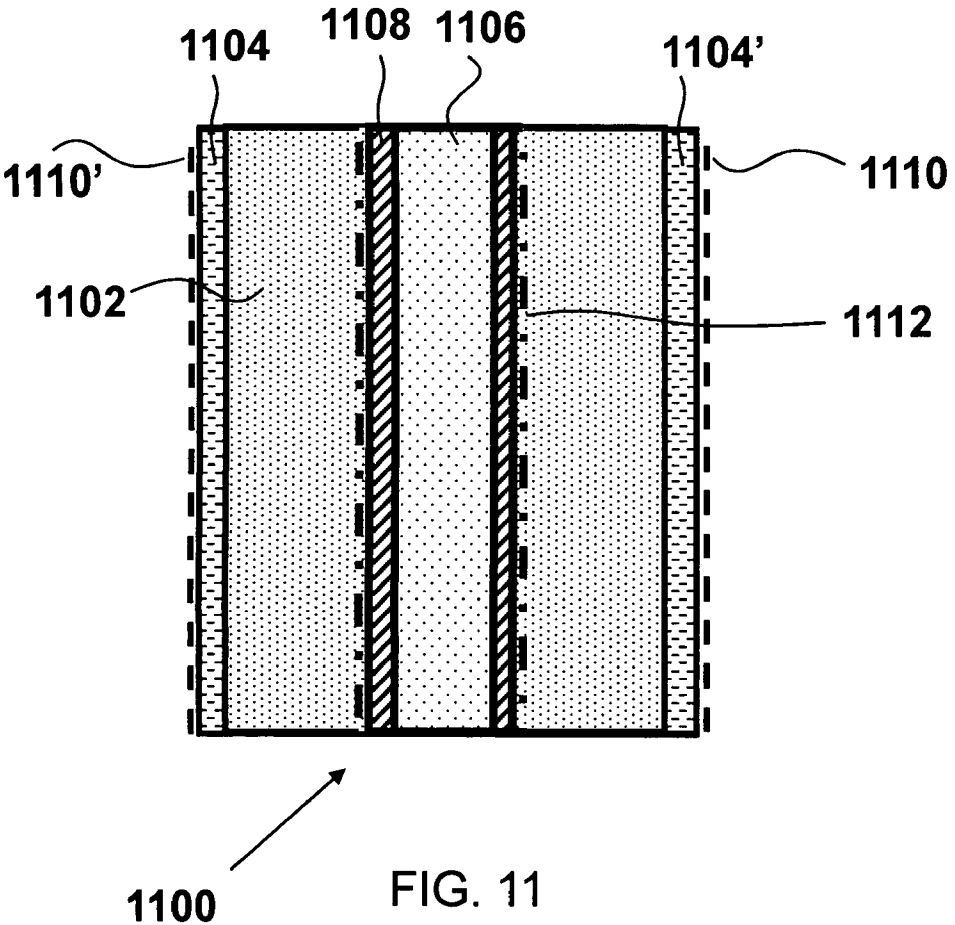
FIG. 11 is an illustration of another layer of dielectric that is inserted between the gas-fill vessel and the outside shield, according to the present invention.

FIG. 11 depicts another aspect of the present invention, in which a second dielectric layer 1104 and 1104' in the shape of an annular cylinder or cylindrical shell surrounds the gas-fill vessel 1102 (bulb). The dielectric layer 1104 and 1104' is made from an optically transparent dielectric material. A non-limiting example of optically transparent dielectric material is sapphire; a non-limiting example of optically translucent material is translucent alumina. The center conductor 1106 is surrounded with a dielectric layer 1108 (similar to the embodiment of the invention in FIG. 9) and fits inside the hollow core 1112 of the gas-fill vessel 1102. A wire-mesh 1110 and 1110' surrounds the gas-fill vessel 1102 and acts as the outer conductor (shield or ground plane) for the coaxial waveguide 1100.

Figure 12:
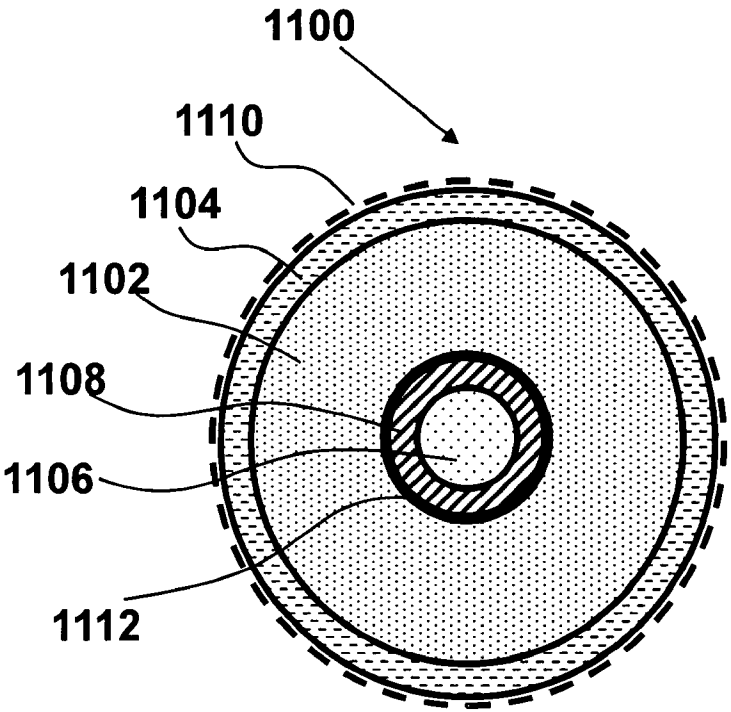
FIG. 12 is a cross-sectional view of the lamp shown in FIG. 11.

FIG. 12 is a schematic of the cross-section of the lamp in FIG. 11, showing the center conductor 1106, the first dielectric layer 1108, the quartz annular cylinder-shaped bulb 1102, the second dielectric layer 1104, and the wire-mesh grid ground 1110.

Figure 13:
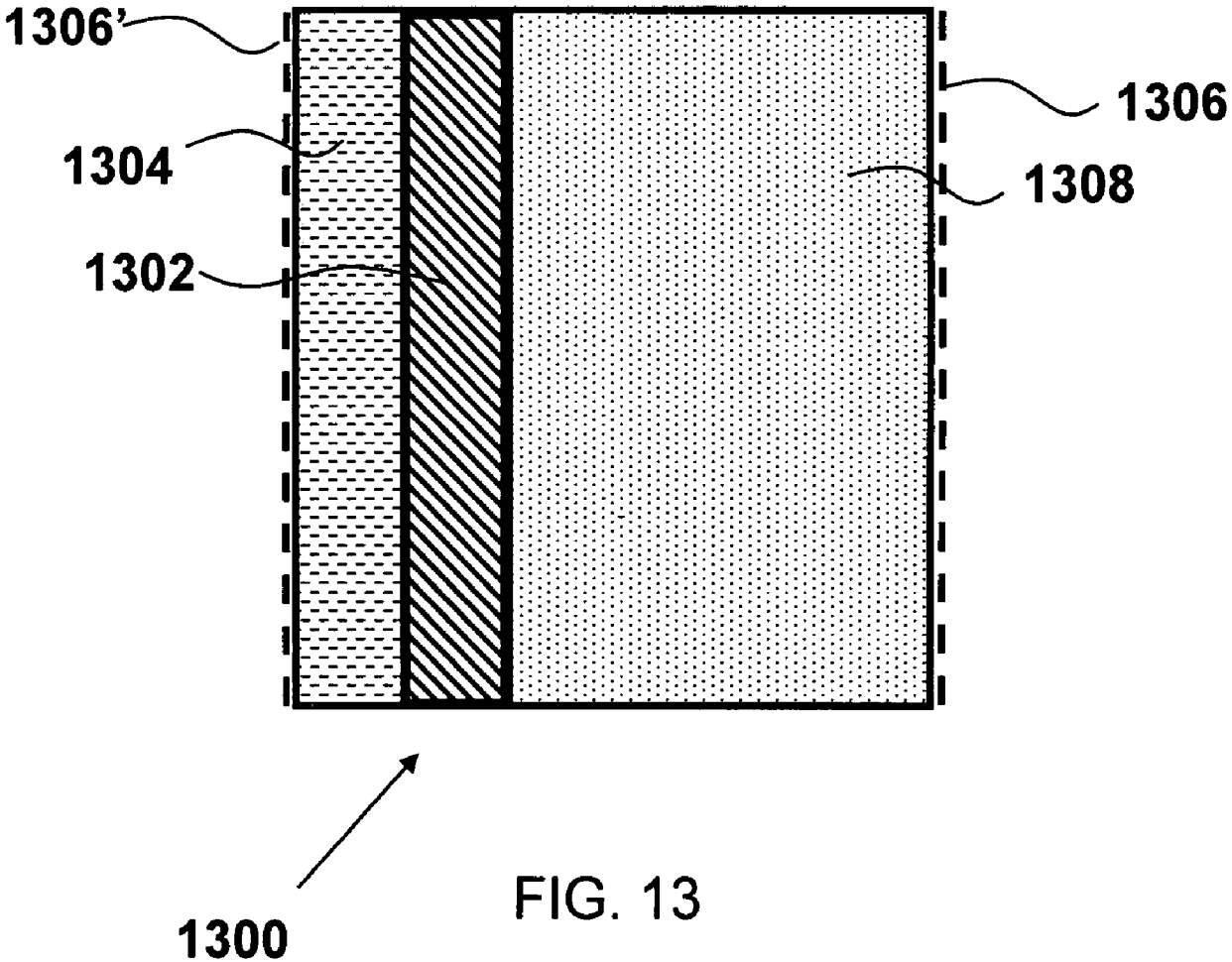
FIG. 13 is an illustration of a leaky coaxial waveguide, which couples RF into a gas-fill vessel that is cylindrical, according to the present invention.

FIG. 13 depicts another embodiment of the invention. Here a leaky waveguide electrodeless lamp 1300 made from a partial coaxial waveguide in the form of a leaky waveguide 1302 and 1304 is in close proximity to a cylindrically-shaped gas-fill vessel 1308, which couples RF energy into the gas-fill vessel 1308. Layer 1304 is a dielectric layer, similar to the dielectric layer of an RF coaxial waveguide. The gas-fill vessel 1308 and leaky waveguide 1302 and 1304 are surrounded by a ground shield 1306 and 1306'. Another dielectric layer can be added between the conductor 1302 and the wall of the gas-fill vessel 1308. The materials used to make the leaky waveguide electrodeless lamp 1300, as shown here, are substantially similar to the materials in the coaxial waveguide electrodeless lamp described above.

Figure 14:
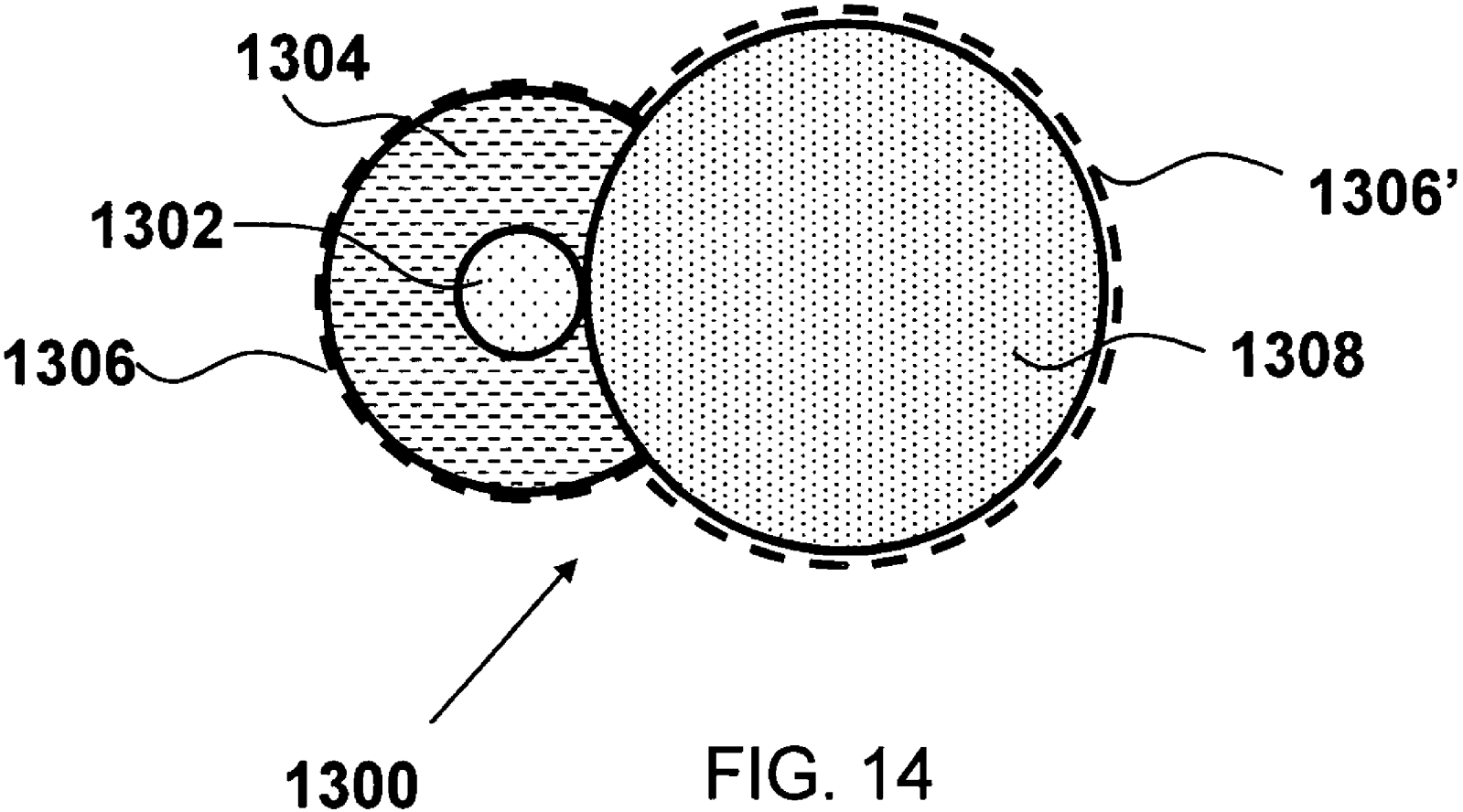
FIG. 14 is a cross-sectional view of the lamp shown in FIG. 13.

FIG. 14 is a cross-section of the lamp 1300 in FIG. 13. FIG. 14 shows the center conductor 1302 of the leaky coaxial waveguide, the dielectric 1304 of the leaky coaxial waveguide, cylindrically-shaped bulb 1308, and wire-mesh ground plane 1306 and 1306'.

Figure 15:
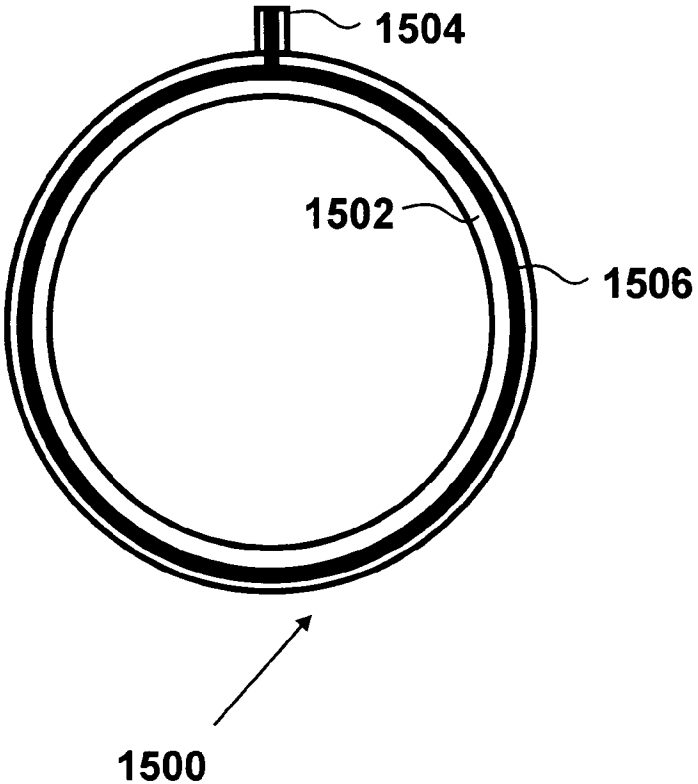
FIG. 15 is an illustration of a lamp that is made into the shape of a ring with a single feed point, according to the present invention.

FIG. 15 depicts a lamp 1500 that is made in the shape of a ring from the coaxial waveguide electrodeless lamp shown in FIG. 7. The lamp 1500 has a single RF feed-point 1504 feeding the center conductor 1506 surrounded by the gas-fill vessel 1502.

Figure 16:
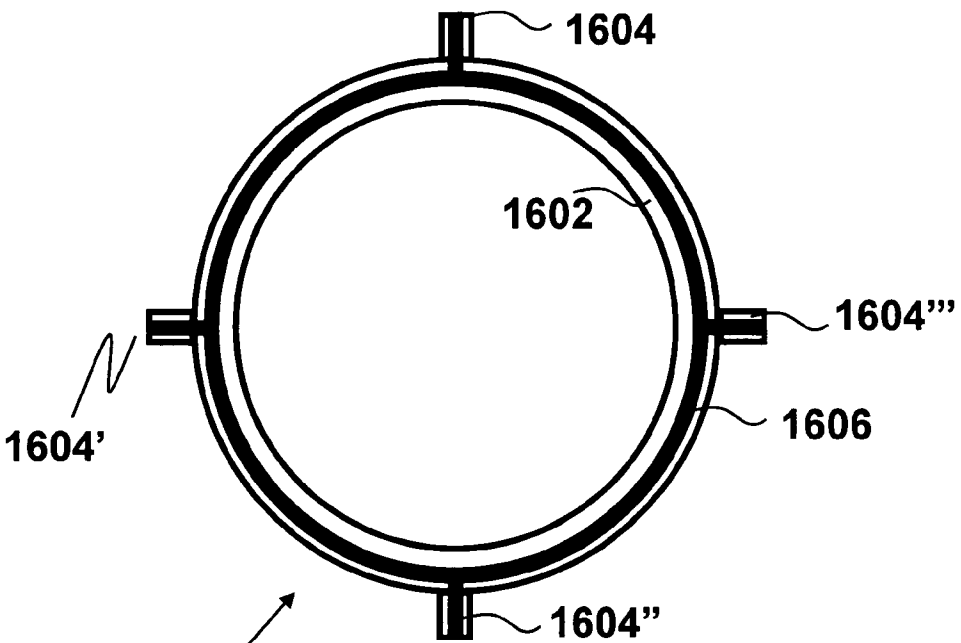
FIG. 16 is an illustration of a lamp that is made into the shape of a ring with a multiple feed points, according to the present invention.

FIG. 16 depicts another lamp 1600 that is made in the shape of a ring from the coaxial waveguide electrodeless lamp shown in FIG. 7. The lamp 1600 has four RF feed-points 1604, 1604', 1604", and 1604'" feeding the center conductor 1606 surrounded by the gas-fill vessel 1602. Using four RF feed-points it is possible to illuminate longer circular lamps.

Figure 17:
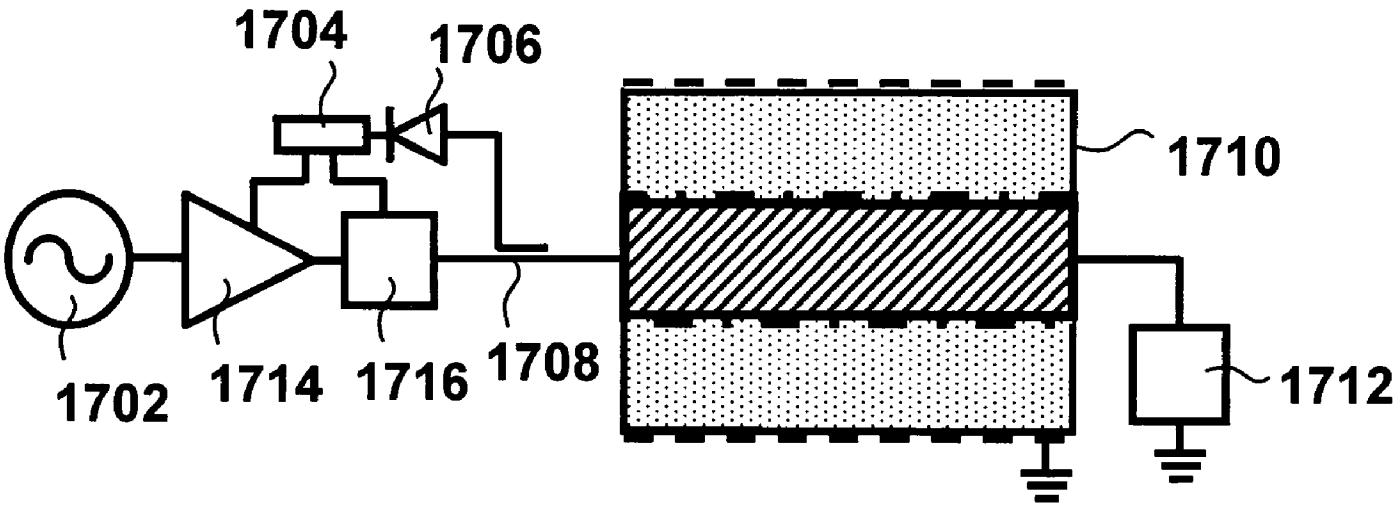
FIG. 17 is a schematic of the lamp in FIG. 7, shown being driven by an RF source and an amplifier, according to the present invention.

FIG. 17 is a schematic of a coaxial waveguide electrodeless lamp 1710 (as shown in FIG. 7) with the lamp 1710 being driven by an RF source 1702 and an RF power amplifier 1714. The RF power is applied to the coaxial waveguide electrodeless lamp 1710 through a resonator 1716 (or matching network). The resonator 1716 can be any type of resonator or it could comprise tunable lumped element RLC components. A detector 1706 measures the output of the lamp for feedback. The detector 1706 can be a photodiode, used to measure a sample of the light output from the lamp and (through a microcontroller 1704) adjust the tunable RLC components and/or the amplifier to maximize the light output. Alternatively the detector 1706 can be a diode RF detector, used to measure the reflected RF power form the lamp using a coupler 1708 and (through the microcontroller 1704) adjust the tunable RLC components and/or the amplifier to minimize reflected RF power from the lamp. A termination 1712 which can be a load, short, or an open circuit is used at the output of the lamp to maximize the efficiency and the light output of the lamp.

Figure 18:
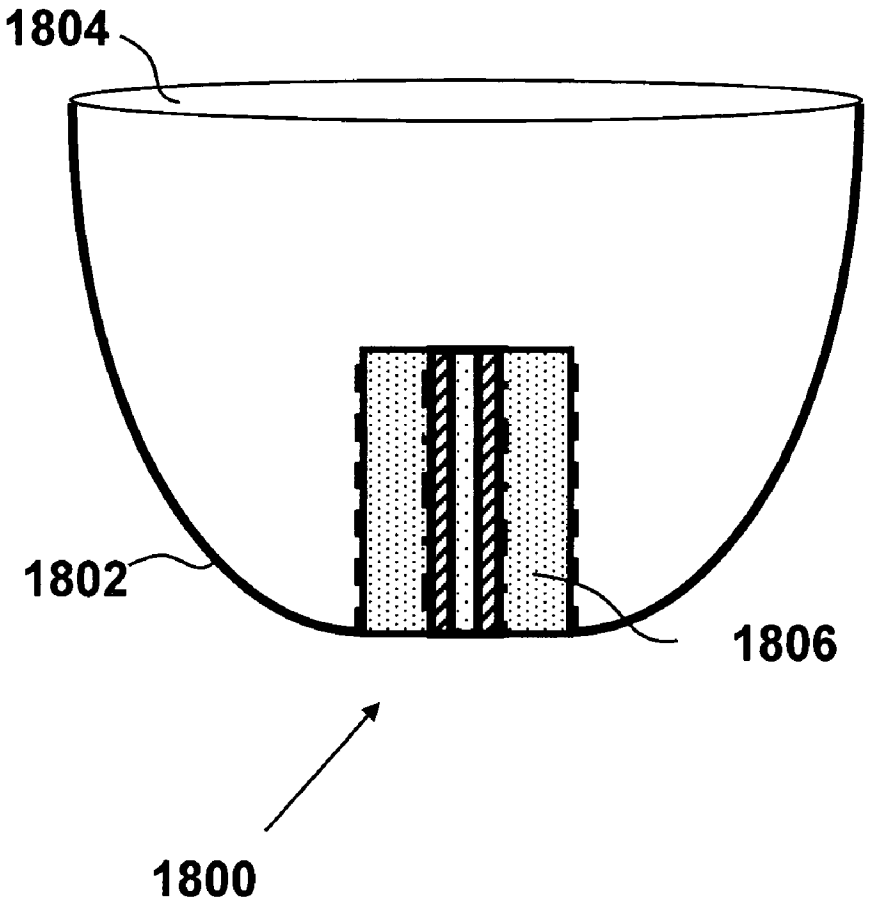
FIG. 18 is an illustration of the lamp of FIG. 9, shown as being inside a parabolic reflector.

FIG. 18 depicts the coaxial waveguide electrodeless lamp 1806 of FIG. 9 as being inside a parabolic reflector 1802 to collect the light from the bulb. A protective transparent cover 1804 or lens is used to enclose the lamp inside the reflector.

Figure 19:
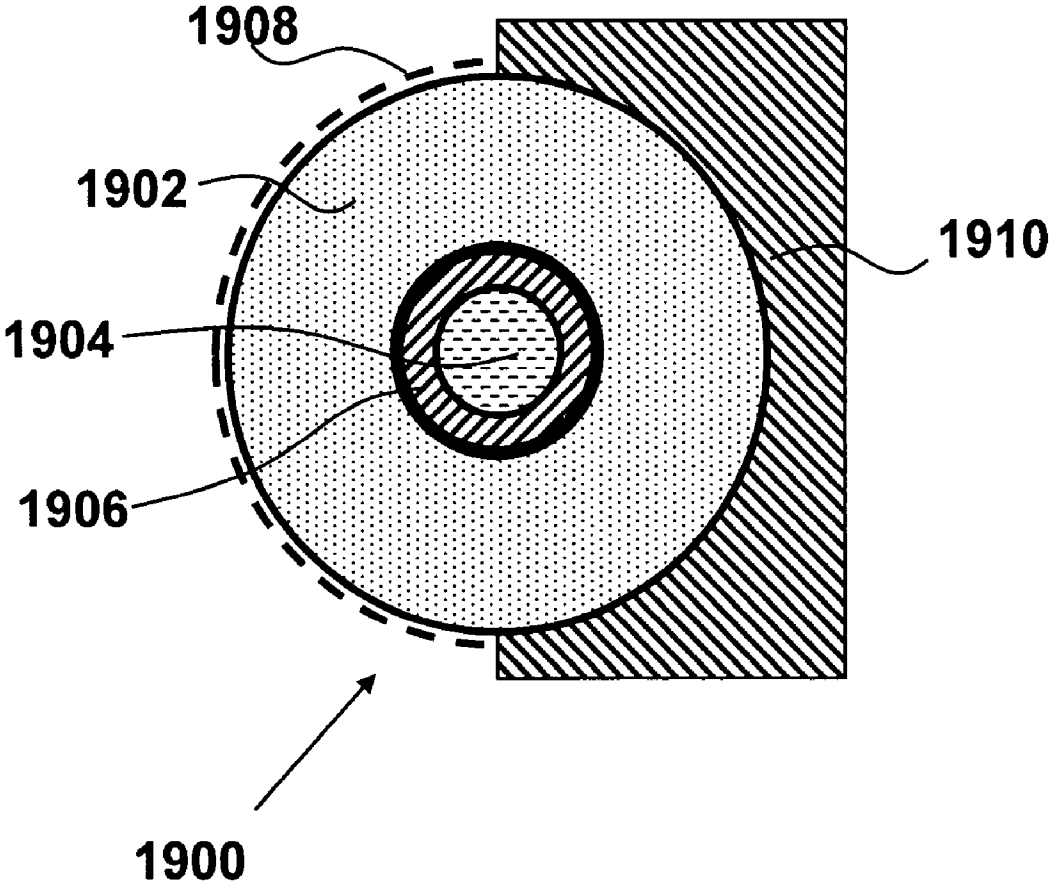
FIG. 19 is a cross-sectional view of a lamp according to the present invention.

FIG. 19 depicts a modified cross-section of the lamp of FIG. 9, wherein half of the wire-mesh 1908 is replaced by a solid ground plane 1910, which also acts as a mirror to reflect light, can act as a heat sink for removing heat from the gas-fill vessel 1902. The center conductor 1904 and dielectric-enhancement layer 1906 are as described above.

Figure 20:
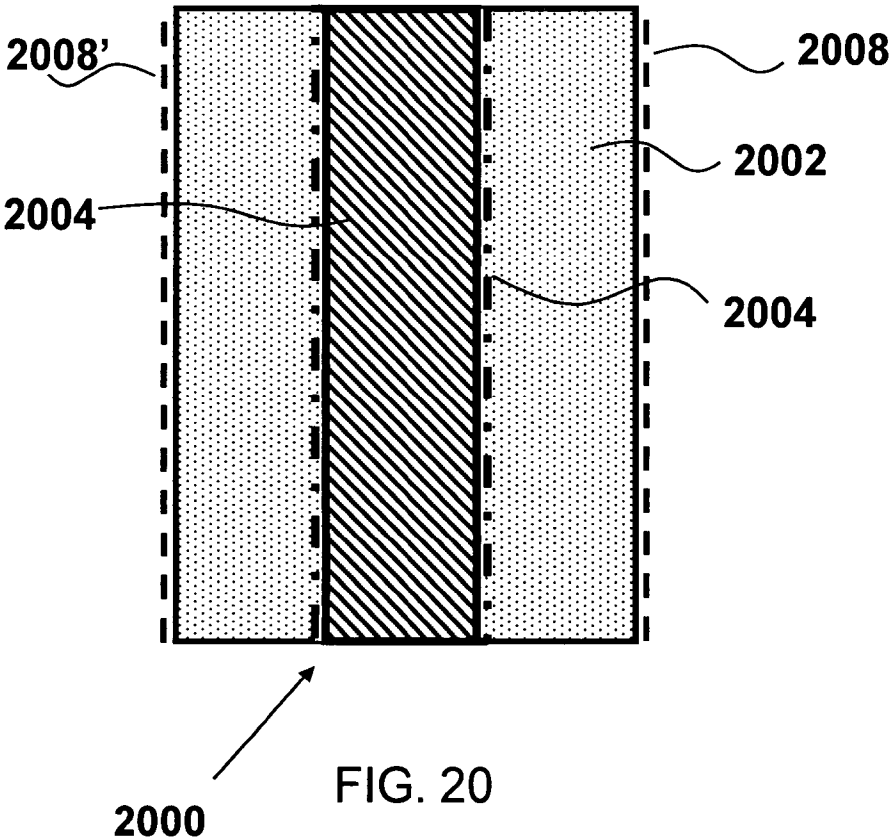
FIG. 20 is a top-view of a gas-fill vessel (bulb) used in a leaky waveguide lamp with a square cross-section, according to the present invention.

FIG. 20 depicts another aspect of the present invention in the form of a "strip-line" waveguide electrodeless lamp. In this aspect, the center conductor 2004 has a square cross-section. The gas-fill vessel 2002 also has a cross-section substantially in the shape of a square annulus. The hollow cavity 2005 also has a square cross-section. The substantially transparent or translucent outer conductor 2008 and 2008', which can take the form of a wire-mesh with high percentage of open area or transparent/translucent outer conductor (such as Indium-Tin Oxide), surrounds the outside wall of the quartz bulb to form the shield or ground conductor of the coaxial waveguide. The outer conductor 2008 and 2008' also has a square cross-section. The invention arranged as shown in FIG. 20 extends the fabrication possibilities of the present invention to the methods used to make one of the most common types of RF waveguides (i.e. the "strip-line" waveguide).

Figure 21:
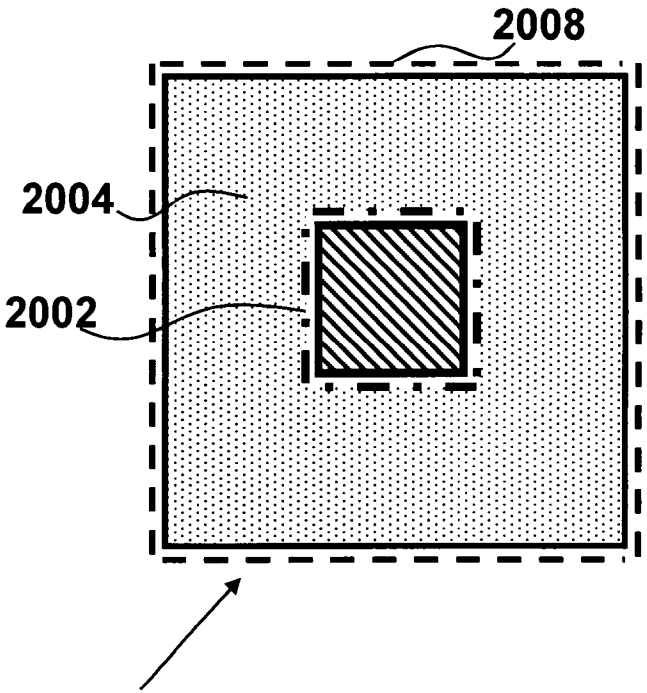
FIG. 21 is a cross-sectional, side view of the gas-fill vessel of FIG. 20; and Appendix A is another aspect of a plasma electrodeless lamp according to the present invention.

FIG. 21 is a schematic of the cross-section of the lamp in FIG. 20 showing that the center conductor 2004, the square annulus-shaped bulb 2002, and the outer conductor 2008 all have square cross-sections. Any of the cross-sections of the elements in FIG. 20 and FIG. 21 could be made rectangular and shifted so that things are not axisymmetric resulting in substantially the same operational characteristics of the lamp.

(4) Additional Details of the Invention

The present invention provides distinct advantages over the electrodeless plasma lamps that are disclosed in the prior art. The top-view of one of the embodiments is shown in FIG. 7 and a view of its cross-section is shown in FIG. 8. The electrodeless lamp of the present invention is designed in analogy to the shape of a coaxial waveguide (coax), where: the bulb (gas-fill vessel) serves as the dielectric material; one external electrode through the center hole of the bulb forms the center conductor of the coax; and a second electrode in the form of a wire-mesh surrounding the bulb forms the ground/shield of the coax. The bulb (shown in FIG. 4, FIG. 5, and FIG. 6) is made from quartz, glass, or other similar materials and is in the shape of a cylinder with a hollow center (elongated donut). The bulb is filled with at least one noble gas and a metal halide salt (or mercury, etc.) and it is completely enclosed with no metal electrodes inside the bulb. An electrode (made from copper or other similar material with an added thin layer of a high melting-point metal to act as a diffusion barrier between copper and quartz) in the shape of a wire/rod with the same diameter as the center hole of the bulb is passed through the center hole of the bulb. A second electrode that is in a form of a wire-mesh (also made from copper or other similar material with an added diffusion barrier metal or dielectric) wraps around the outer diameter of the bulb. This second electrode acts as the ground plane (shield) for the coaxial waveguide. RF energy propagating through this coaxial waveguide structure will ionize the gas in the bulb as well as melt/vaporize the metal halide salt. The interaction of ionized gas and the metal halide vapor will emit light through the holes in the wire-mesh. (Alternatively, instead of wire-mesh, transparent electrodes can be used as ground conductor which will also act as the second conductor for the electrodeless lamp). Such a lamp structure designed in analogy to a coaxial waveguide offers a number of advantages including: a wide frequency range of RF sources, including low frequencies (from a 1 MHz to over 10 GHz); improved scalability to longer bulb lengths, producing large amounts of light; and the bulb can also be made into various shapes for different applications.

In another aspect and as illustrated in FIG. 9 and FIG. 10, an additional dielectric ring (made out of materials such as alumina) is added around the center electrode between the center conductor and the bulb. This dielectric layer will add an additional design parameter to optimize the coupling of the RF field into the bulb. In particular, the addition of a material with a higher dielectric constant than quartz (or bulb material) will serve the purpose of increasing the capacitance per unit length of the coaxial waveguide electrodeless lamp.

In another aspect, one can use a coaxial waveguide that has been cut through half of its dielectric to construct a "leaky" waveguide as shown in FIG. 13. This leaky waveguide can be placed in close proximity to a cylindrical gas-fill vessel (bulb filled with a noble gas and a metal halide salt). RF energy coupled into this leaky waveguide will energize the gas inside the bulb and melt/vaporize the metal halide salt to cause light emission from the bulb.

As can be appreciated by one of ordinary skill in the art, although the above description utilizes many specific measurements and parameters, the invention is not limited thereto and is to be afforded the widest scope possible. Additionally, although the device is described as being used as a lamp which produces visible light for illumination, it is not intended to be limited to this region of the electromagnetic spectrum and can be incorporated into a wide array of devices for a large variety of uses, including uses which require illumination in the ultra-violet and infrared portions of the electromagnetic spectrum.

What is claimed is:

1. A coaxial waveguide electrodeless lamp, comprising:

a gas-fill vessel for containing gas being substantially hollow, substantially transparent or substantially translucent and substantially in the shape of a closed, annular cylinder, the gas-fill vessel further comprising:

a first end;

a second end;

an outer diameter;

an inner diameter;

a first annular cap on the first end;

a second annular cap on the second end;

a closed cavity defined by the outer diameter, the inner diameter, the first annular cap and the second annular cap;

a hollow core bounded by the inner diameter;

a length from the first end to the second end; and a long axis;

a central conductor that is substantially cylindrical, having a length and having a diameter substantially similar to the inner diameter of the gas-fill vessel, the central conductor having a long axis substantially parallel to the long axis of the gas-fill vessel, the central conductor fitting substantially within the hole of the gas-fill vessel for at least a portion of the length of the central conductor;

an outer conductor that is substantially transparent or substantially translucent and substantially in the shape of a cylindrical shell, the outer conductor having a length and a long axis substantially parallel to the long axis of the central conductor and substantially parallel to the long axis of the gas-fill vessel, the outer conductor having a diameter substantially similar to the outer diameter of the gas-fill vessel, the outer conductor fitting substantially around the gas-fill vessel for at least a portion of the length of the outer conductor; and a gas-fill contained inside the closed cavity of the gas-fill vessel, the gas-fill comprising at least one substance selected from the group consisting of gas, liquid, and solid, whereby the coaxial waveguide electrodeless lamp emits light through the outer conductor when electromagnetic radiation carried by the outer conductor and the central conductor interacts with the gas-fill.

2. A coaxial waveguide electrodeless lamp as set forth in claim 1, wherein the outer conductor comprises:

a conductive layer that is substantially transparent or substantially translucent; and a substrate layer that is substantially transparent or substantially translucent, the substrate layer in intimate contact with the conductive layer, whereby the substrate layer provides structural support for the conductive layer.

3. A coaxial waveguide electrodeless lamp as set forth in claim 1, wherein the center conductor is made from a conductive metal.

4. A coaxial waveguide electrodeless lamp as set forth in claim 1, wherein the coaxial waveguide electrodeless lamp is electrically terminated by a load, short, or open circuit to maximize light output.

5. A coaxial waveguide electrodeless lamp as set forth in claim 1, wherein the gas-fill comprises at least one inert gas and at least one fluorophor.

6. A coaxial waveguide electrodeless lamp as set forth in claim 1, wherein the gas-fill comprises at least one inert gas.

7. A coaxial waveguide electrodeless lamp as set forth in claim 1, wherein the gas-fill vessel is made of quartz, fused silica, or glass.

8. A coaxial waveguide electrodeless lamp as set forth in claim 1, wherein at least a portion of the gas-fill vessel has a refractory veneer, whereby the refractory veneer prevents diffusion of impurities into the gas-fill vessel.

9. A coaxial waveguide electrodeless lamp as set forth in claim 1, wherein the lamp is substantially in the shape of a "U" having a substantially cylindrical cross-section, the lamp having at least one RF input.

10. A coaxial waveguide electrodeless lamp as set forth in claim 1, wherein the lamp is substantially in the shape of a torus having a substantially cylindrical cross-section, the lamp having at least one RF input.

11. A coaxial waveguide electrodeless lamp as set forth in claim 1, wherein the outer conductor is a mesh, the mesh substantially transparent and made from a conducting metal, where the percentage of open area of the mesh is substantially high to make the mesh substantially transparent without substantially compromising the conductivity of the outer conductor.

12. A coaxial waveguide electrodeless lamp as set forth in claim 1, wherein the outer conductor is made of a conductive material that is substantially transparent or substantially translucent.

13. A coaxial waveguide electrodeless lamp as set forth in claim 1, wherein:

the coaxial waveguide electrodeless lamp further comprises a dielectric-enhancing layer, the dielectric-enhancing layer being made of a material with dielectric constant of at least two, and being shaped substantially as an annular cylinder with an inner diameter, an outer diameter, and a long axis substantially parallel to the long axis of the center conductor;

the inner diameter of the gas-fill vessel is substantially similar to the outer diameter of the dielectric-enhancing layer, rather than the outer diameter of the center conductor;

the outer diameter of the center conductor is substantially similar to the inner diameter of the dielectric-enhancing layer, rather than the inner diameter of the gas-fill vessel; and the dielectric-enhancing layer fits substantially between the gas-fill vessel and the center conductor, whereby the dielectric-enhancing layer serves to optimize RF-electrical properties of the coaxial waveguide electrodeless lamp.

14. A coaxial waveguide electrodeless lamp as set forth in claim 1, wherein:

the coaxial waveguide electrodeless lamp further comprises a dielectric-enhancing layer, the dielectric-enhancing layer being made of a substantially transparent or substantially translucent material with dielectric constant of at least two, and being shaped substantially as an annular cylinder with an inner diameter, an outer diameter, and a long axis substantially parallel to the long axis of the center conductor;

the outer diameter of the gas-fill vessel is substantially similar to the inner diameter of the dielectric-enhancing layer, rather than the diameter of the outer conductor;

the diameter of the outer conductor is substantially similar to the outer diameter of the dielectric-enhancing layer, rather than the outer diameter of the gas-fill vessel; and the dielectric-enhancing layer fits substantially between the gas-fill vessel and the outer conductor, whereby the dielectric-enhancing layer serves to optimize RF-electrical properties of the coaxial waveguide electrodeless lamp.

15. A coaxial waveguide electrodeless lamp as set forth in claim 1, further comprising:

an RF power source;

a power amplifier, the power amplifier being made from solid-state components or equivalents thereof; and a tunable RF coupler, the tunable RF coupler being comprised of a tunable matching network, a tunable resonator, or a combination of tunable matching networks and tunable resonators, whereby RF energy is produced by the RF power source, amplified by the power amplifier, and coupled to the coaxial waveguide electrodeless lamp by the tunable RF coupler.

16. A coaxial waveguide electrodeless lamp as set forth in claim 11, wherein a portion of the mesh is replaced by a solid metal sheet of substantially the same shape as the portion of the mesh that is replaced, the solid metal sheet being made from a substantially conductive, substantially reflective material, whereby the solid metal sheet acts as a heat sink and a mirror, providing directional light output.

17. A coaxial waveguide electrodeless lamp as set forth in claim 16, wherein the solid metal sheet replaces approximately 180 degrees of the mesh for at least a portion of the length of the outer conductor.

18. A coaxial waveguide electrodeless lamp as set forth in claim 12, wherein a portion of the conductive material is coated with a frequency-conversion material, whereby the frequency-conversion material converts light emitted by the gas-fill to light of other frequencies.

19. A coaxial waveguide electrodeless lamp as set forth in claim 12, wherein a portion of the conductive material is coated with a reflective material, providing directional light output.

20. A coaxial waveguide electrodeless lamp as set forth claim 19, where the reflective material is a dielectric mirror or a substantially reflective metal.

21. A coaxial waveguide electrodeless lamp as set forth in claim 20, wherein 180 degrees of the conductive material is coated with the reflective material.

22. A coaxial waveguide electrodeless lamp as set forth in claim 13, wherein the dielectric-enhancing layer is made from sapphire or substantially translucent alumina.

23. A coaxial waveguide electrodeless lamp as set forth in claim 14, wherein the dielectric-enhancing layer is made from sapphire or alumina.

24. A coaxial waveguide electrodeless lamp as set forth in claim 15, wherein a photodetector is capable of sampling light output from the coaxial waveguide electrodeless lamp and provides a feedback signal to the tunable RF coupler, whereby the tunable RF coupler is tuned to maximize light output.

25. A coaxial waveguide electrodeless lamp as set forth in claim 15, wherein an RF detector is capable of sampling reflected RF power from the coaxial waveguide electrodeless lamp and providing a feedback signal to the tunable RF coupler, whereby the tunable RF coupler is tuned minimize reflected RF power and thus maximize RF power coupled to the coaxial waveguide electrodeless lamp.

* * * * *